US010787885B2

(12) United States Patent
Cote et al.

(10) Patent No.: US 10,787,885 B2
(45) Date of Patent: Sep. 29, 2020

(54) UPSTREAM SHUTTLE VALVE FOR USE WITH PROGRESSIVE CAVITY PUMP

(71) Applicants: Brennon Leigh Cote, Cochrane (CA); Edward Moore, Calgary (CA)

(72) Inventors: Brennon Leigh Cote, Cochrane (CA); Edward Moore, Calgary (CA)

(73) Assignees: Brennon Leigh Cote, Cochrane, AB; Edward Moore, Calgary, AB ( * ) Notice: Subject to any disclaimer, the term of this patent is extended or adjusted under 35 U.S.C. 154(b) by 427 days.

(21) Appl. No.: 15/364,735

(22) Filed: Nov. 30, 2016

(65) Prior Publication Data

US 2017/0152724 A1 Jun. 1, 2017

Related U.S. Application Data

(60) Provisional application No. 62/261,041, filed on Nov. 30, 2015.

(51) Int. Cl.

| | |
|---|---|
| ***E21B 34/08*** | (2006.01) |
| ***E21B 34/14*** | (2006.01) |
| ***E21B 43/12*** | (2006.01) |

(52) U.S. Cl.

CPC ..... *E21B 34/08* (2013.01); *E21B 34/14* (2013.01); *E21B 43/121* (2013.01)

(58) Field of Classification Search

CPC ..... E21B 34/08; E21B 34/14; E21B 43/121; E21B 43/126; F16K 15/021

See application file for complete search history.

(56) References Cited

U.S. PATENT DOCUMENTS

| | | | | |
|---|---|---|---|---|
| 4,969,697 | A | 11/1990 | Lindenman | |
| 6,371,206 | B1 * | 4/2002 | Mills | E21B 43/121 166/105 |
| 2005/0079063 | A1 | 4/2005 | Zupanick | |
| 2006/0124881 | A1 * | 6/2006 | Mentesh | F16K 5/0407 251/121 |
| 2008/0199339 | A1 | 8/2008 | Near | |
| 2009/0242208 | A1 * | 10/2009 | Bolding | E21B 43/10 166/371 |
| 2015/0184487 | A1 * | 7/2015 | Osborne | E21B 34/08 166/373 |

FOREIGN PATENT DOCUMENTS

WO 2015075636 A1 5/2015

* cited by examiner

*Primary Examiner* — Caroline N Butcher
(74) *Attorney, Agent, or Firm* — Field LLP

(57) ABSTRACT

An artificial lift system is provided for use for pumping fluid from a downhole wellbore to surface. The system comprises a progressive cavity pump, said progressive cavity pump comprising a stator run on a tubing string and a rotor run on a rod string into the stator and a shuttle valve positioned upstream of the progressive cavity pump, wherein said shuttle valve comprises a non-weighted shuttle and wherein said non-weighted shuttle is moveable axially within said shuttle valve from force of fluid alone. An upstream shuttle valve is further provided for use upstream of a progressive cavity pump, wherein said shuttle valve comprises a non-weighted shuttle that is moveable axially within said shuttle valve from a force of fluid alone, to open and close the shuttle valve. A method is further still provided for pumping fluid from a wellbore in an artificial lifts system.

26 Claims, 13 Drawing Sheets

UPSTREAM SHUTTLE VALVE FOR USE WITH PROGRESSIVE CAVITY PUMP

FIELD

The present disclosure relates to a shuttle valve and more particularly for a shuttle valve for use with a downhole progressive cavity pump system.

BACKGROUND

The subject of the present disclosure relates generally to downhole wellbore systems used for pumping hydrocarbon products to surface. Such systems are often called artificial lift systems. The present systems typically use a progressive cavity (PC) pump to pump liquid hydrocarbon from underground formations in a cased wellbore up to surface. The stator portion of the PC pump is typically run down on a tubing string and the rotor portion of the PC pump is run into the stator on a rod string. Fluid is pumped through the tubing string to surface. A fluid column is also present in the annulus between the tubing string and the wellbore casing.

In many artificial lift operations, steady power supply is a problem and power failures are common. When power to a PC pump motor is lost and the PC pump fails to pump fluid, fluid level within the tubing string drops to a level equal to the fluid level in the tubing-casing annulus. This causes a number of problems, the first of which the need for a lengthy re-start up time when power to the PC pump motor is eventually restored, since fluid level within the tubing string must again be pumped back up to surface. Further re-start up time is required to get production rates back to where they were prior to the power failure. In some cases re-start up time can result in the loss of several days of production time.

A second problem with PC pump shut down is that gases that are entrained in the high pressure fluid being pumped and migrate into the elastomeric material otherwise known as gas impregnation. Gas molecules then expand or deform the elastomeric material once it is no longer pressurized by pumping. The released gas bubbles tend to migrate into the elastomeric material of the PC pump stator and cause bulging and warping of the shape of the stator profile also known as explosive decompression in elastomeric compounds. When power is restored and the PC pump is run again, the rotor no longer fits properly in the warped and bulging stator and rotation of the rotor tends to gouge out parts of the stator material. This causes a number of problems in production, blockage within the tubing and of course equipment damage.

To avoid loss of fluid level in the tubing string during power failures and PC pump shut down, it is known to place a check valve downstream of the PC pump, to allow upstream flow during operation, but to prevent downstream flow back into the formation during PC pump shut down. An example of such a downstream check valve can be seen in US 2011/0259438, inventor Lawrence Osborne.

Downstream check valves can cause issues when running the rotor portion of the PC pump down on the rod string into the stator portion of the PC pump. Since the check valve prevents flow of fluid downstream, fluid in the stator cavity cannot be displaced when the rotor is being run in, causing difficulty in installing the rotor and improper alignment of the rotor within the stator. Downstream check valves also present flow restrictions at the PC pump intake.

While a prior art upstream check valve can be seen in WO/2015075636, owned by Serinpet of Colombia, this check valve is operated on inertial mass and requires an enlarged tubing string ID surrounding the valve to overcome flow losses as fluid passes around the check valve and travels upstream to surface.

There is therefore a need to design a flow restriction system that prevents fluid level losses in artificial lift applications that is easy to install, reduces flow losses, and does not require special equipment. There is also a need to provide flow restriction systems with improved sealing to ensure lack of back flow and having a centralized design for deviated or horizontal wells.

SUMMARY OF THE INVENTION

An artificial lift system is provided for use for pumping fluid from a downhole wellbore to surface. The system comprises a progressive cavity pump, said progressive cavity pump comprising a stator run on a tubing string and a rotor run on a rod string into the stator and a shuttle valve positioned upstream of the progressive cavity pump, wherein said shuttle valve comprises a non-weighted shuttle and wherein said non-weighted shuttle is moveable axially within said shuttle valve from force of fluid alone.

An upstream shuttle valve is further provided for use upstream of a progressive cavity pump, wherein said shuttle valve comprises a non-weighted shuttle that is moveable axially within said shuttle valve from a force of fluid alone, to open and close the shuttle valve.

A method is further still provided for pumping fluid from a wellbore in an artificial lifts system. The method comprises the steps of providing a progressive cavity pump; providing a shuttle valve upstream of the progressive cavity pump, said shuttle valve comprising a non-weighted shuttle axially moveable within the shuttle valve; opening the shuttle valve to allow flow of fluid upstream from the progressive cavity pump, through the shuttle valve when the progressive cavity pump is pumping; closing the shuttle valve to prevent flow of fluid downstream through the shuttle valve when the progressive cavity pump is stopped, wherein opening and closing of the shuttle valve is performed by moving the shuttle axially from force of fluid flow alone.

DETAILED DESCRIPTION OF EMBODIMENTS OF THE INVENTION

The present disclosure relates to an improved device and method for preventing fluid loss from a tubular string in an artificial lift system.

It is understood that the improved device disclosed herein is not limited in its application to the details of the construction and arrangement of the parts illustrated in the accompanying drawings. The device disclosed herein is capable of other embodiments and configurations and of being practiced or carried out in a variety of ways, and the terminology employed herein are for the purposes of description only and are not intended to be limiting in any way.

Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, phases, or steps may be present, or utilized, or combined with other elements, phases, or steps that are not expressly referenced.

More particularly, the invention relates to a shuttle valve that is used upstream of a PC pump to prevent loss of fluid back down into the well and PC pump backspin, should the PC pump stop working. The shuttle valve also serves to reduce start up time, by maintaining fluid levels in the well when the PC pump re-starts pumping. The present shuttle valve allows flow upstream to the surface, but prevents flow downstream. The present invention further provides three distinct sealing areas within the shuttle valve system. Multiple sealing areas in both the shuttle valve 22 and surrounding equipment ensure no leakage between sections of the shuttle valve system. In securing against leaks, fluid losses are minimized.

Figure 1:
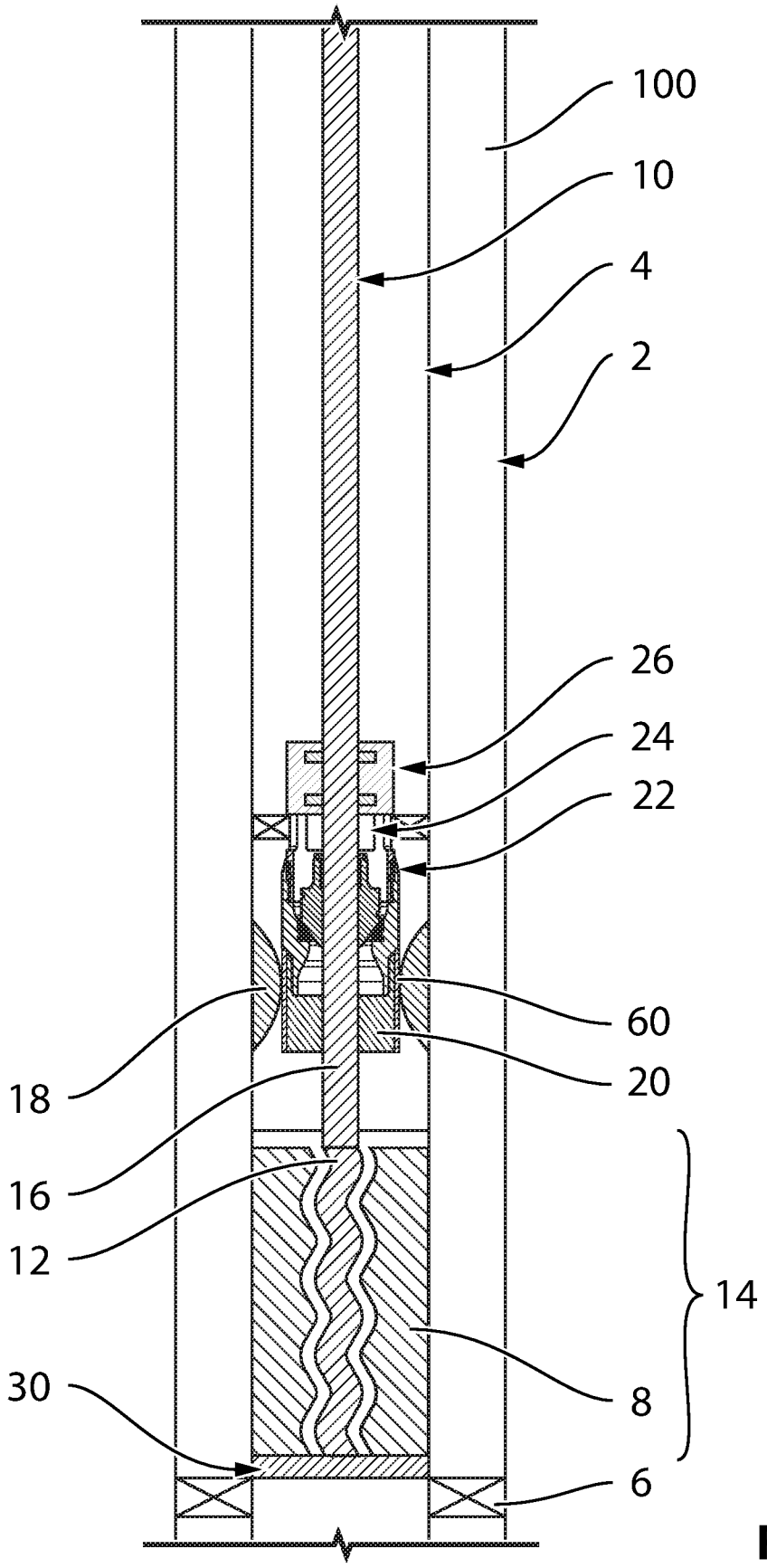
FIG. 1 is a schematic diagram of a down hole well with a PC pump and one embodiment of the shuttle valve of the present invention.
Figure 2B:
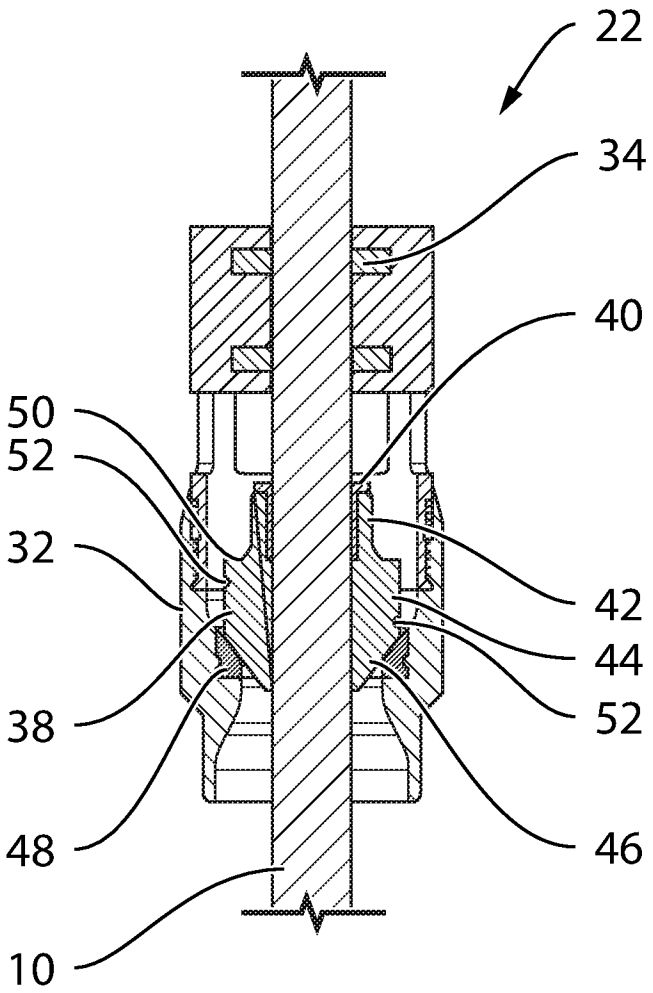
FIG. 2*b* is a cross-sectional view of the embodiment of the shuttle valve of FIG. 1*a;*
Figure 2A:
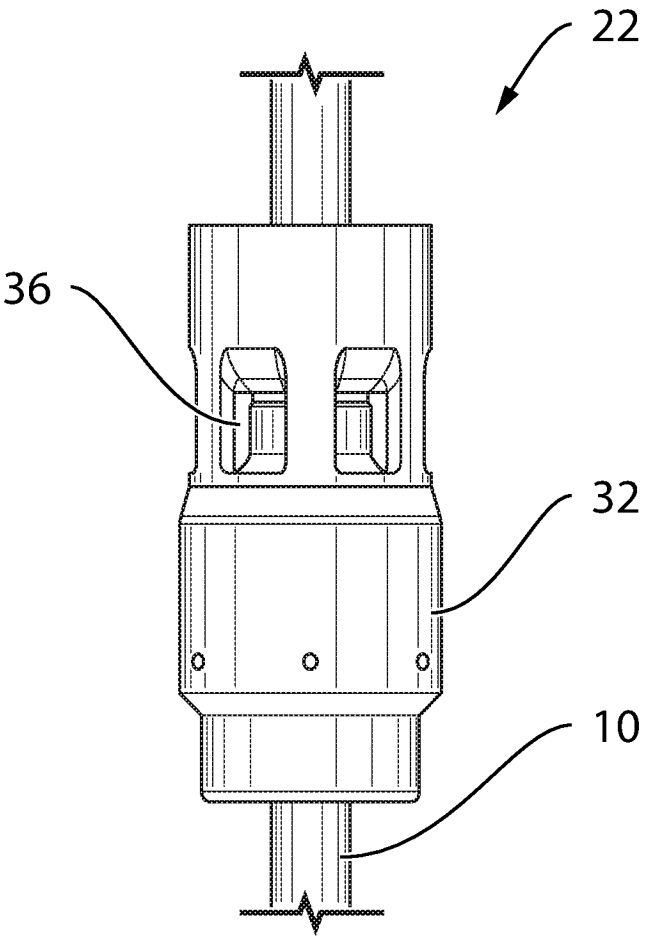
FIG. 2*a* is an elevation view of one embodiment of the shuttle valve of the present invention.

With reference to FIG. 1, a cased 2 wellbore is depicted. A tubing string 4 run into the cased hole 2 and anchored in place by tubing anchor 6. The tubing string 4 comprises a stator portion 8 of a PC pump 14 and also a seating nipple 18. A rod string 10 is run down inside the tubing string 4, the rod string 10 comprising, from bottom to top: a rotor portion 12 of the PC pump 14; one or more optional flexible rod segments 16; a seating mandrel 20 that sits in the seating nipple 18 and comprises the shuttle valve 22; an optional rod torque anchor 24 and an optional bearing box 26.

A tag bar 30 at the lowest end of the tubing string 4, or other means well known in the art, may be used for locating the rotor 12 inside the stator 8.

The seating mandrel 20 fits into the nipple 18 with an interference fit with close tolerances. The fit is designed to hold pressures through the mechanical seal between the seating mandrel 20 and the nipple 18.

In a further embodiment, the seating mandrel 20 is surrounded by a sealing sleeve 60, as depicted in FIG. 1. The sealing sleeve 60 is preferably made from a non-metallic, non-elastomeric material that seals into the seating nipple 18 to create a friction seal and barrier. The sealing sleeve 60 is most preferably made from Teflon™. The non-metallic, non-elastomeric material of the sealing sleeve 60 ensures that it is non-deforming and allows that the seating mandrel 20 can be sealed into the seating nipple 18 with a pressure or force and can be unsealed by releasing an equal pressure, without deforming the seating mandrel 20.

A problem with prior art downstream check valves is that when the rotor part of the PC pump is run down on the rod through the tubing string and into the stator part of the PC pump, the rotor necessarily displaces fluid that was in the stator, but a downstream check valve does not allow that fluid to displace downwardly, leading to a misalignment of the rotor inside the stator. Furthermore, downstream check valves form intake restrictions as fluid needs to displace the ball of the check valve under pressure in order to allow flow into the suction of the pump. Since all wells are under pressure, this results in downstream check valves becoming actuated, and undesirably hindering pump performance.

In the present invention, as illustrated in FIG. 1, the present shuttle valve 22 is located upstream of the PC pump 14 and therefore does not check flow downstream at the PC pump 14, thereby allowing the necessary displacement of fluid downstream from an inside cavity of the stator 8 when the rotor 12 is inserted.

Further details of the shuttle valve of the present invention are now presented, with reference to FIGS. 2*a* to 13.

The present shuttle valve 22 comprises an outer housing 32 that is connected to the seating mandrel 20 that sits in the seating nipple 18. The housing 32 is rotationally coupled to the rod 10, to allow the rod 10 to spin and operate the rotor 12. The shuttle rotates with the inertia of the spinning rod 10. The coupling is preferably a first bushing 34, said first bushing 34 more preferably being made from a high temperature and high wear rating material, most preferably a nano-tube carbon composite, although any other materials known in the art with similar high temperature and wear resistance would be suitable for the purposes of the present invention. The first bushing is preferably designed to have close tolerances to both rod 10 and shuttle valve 22, while also having enough space for the shuttle valve 22 to actuate. The first bushing 34 further preferably acts as a mechanical seal to an internal part of the shuttle valve 22. One or more vents 36 allow fluid bypassing the shuttle valve 22 to travel upstream through the tubing string 4 to surface.

The present shuttle 38 seals against the rod 10 using a mechanical seal design that restricts fluid by-pass and still allows for shuttle actuation along the rod 10 based on fluid moving in either direction. This mechanical seal, formed by the continuous contact between the shuttle 38 and the rod 10 is one complete seal assembly and, unlike the prior art, does not consist of several O-ring seals or other redundant seals that can cause excess friction or deform and restrict movement of the shuttle 38. This form of continuous single mechanical seal operates on an inside of the shuttle 38 and creates virtually no drag or friction between the shuttle 38 and the rod 10.

The shuttle 38 of the shuttle valve 22 is both rotationally and axially moveable about the rod 10. This allows the rod 10 to rotate as it drives the rotor 12, and also allows the shuttle 38 to move up and down axially to open and close the shuttle valve 22. Rotational and axial movement is preferably accommodated through the second bushing 40, said second bushing 40 having similar wear and temperature resistance to the first bushing 34 and more preferably being made from similar materials to the first busing 34.

The shuttle 38 is preferably made from abrasion resistant, lightweight materials that both withstand harsh impact from sand particulate in the oil stream being pumped and also minimize flow losses as fluid bypasses the shuttle valve 22 and travels upstream. More preferably, the shuttle 38 is made from ceramics such as zirconium ceramic, although it would be well understood by a person of skill in the art that other materials could also be used without departing from the scope of the invention.

The present shuttle valve 22 is designed to minimize flow losses around it when fluid is pumped up from the PC pump 14, past the check valve 22 and up to surface. Flow losses are minimized by the unique shape of the shuttle 38. The shuttle 38 comprises a small outside diameter (OD) cylindrical upper portion 42 that flares into a cylindrical mid-section 44, said mid-section 44 having a larger OD than the upper portion 42, and tapers to a conical lower end 46.

The conical lower end 46 shape and the lightweight of the present shuttle 38 results in the shuttle not requiring a great deal of upward flow to lift the shuttle 38 off of cooperating seat 48. The lower end 46 of the shuttle 38 and the seat 48 preferably share a common angle of inclination to allow a good fit, while also preventing the shuttle 38 from deforming into or otherwise getting stuck in the seat 48. Hence the shuttle 38 requires very little upwards fluid flow to open the shuttle valve 22 from a closed position. Since the present shuttle 38 is preferably made from lightweight materials, it allows the shuttle 38 to move axially up and down by force of the flowing fluid alone, with no additional mechanisms needed.

Figure 3B:
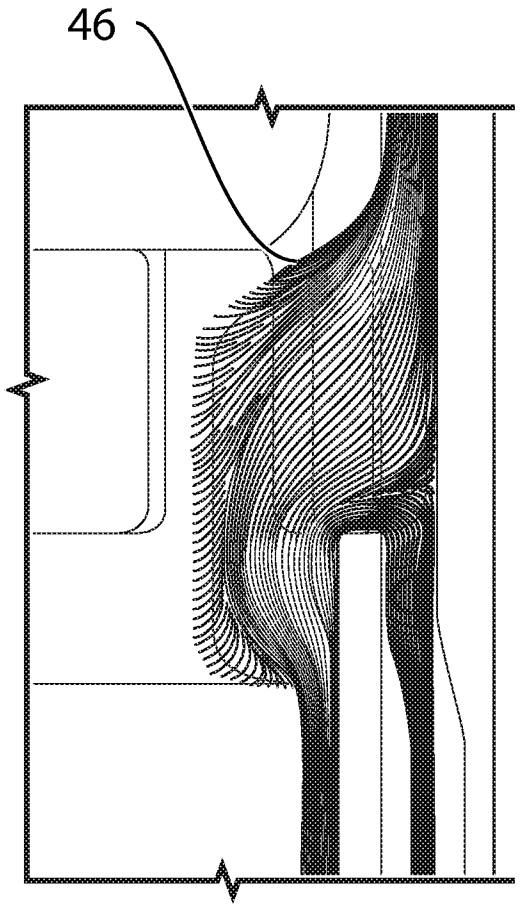
FIG. 3*b* is a cross-sectional detail of a portion of the shuttle valve of the present invention, depicting fluid flow as it bypasses the shuttle valve.
Figure 3A:
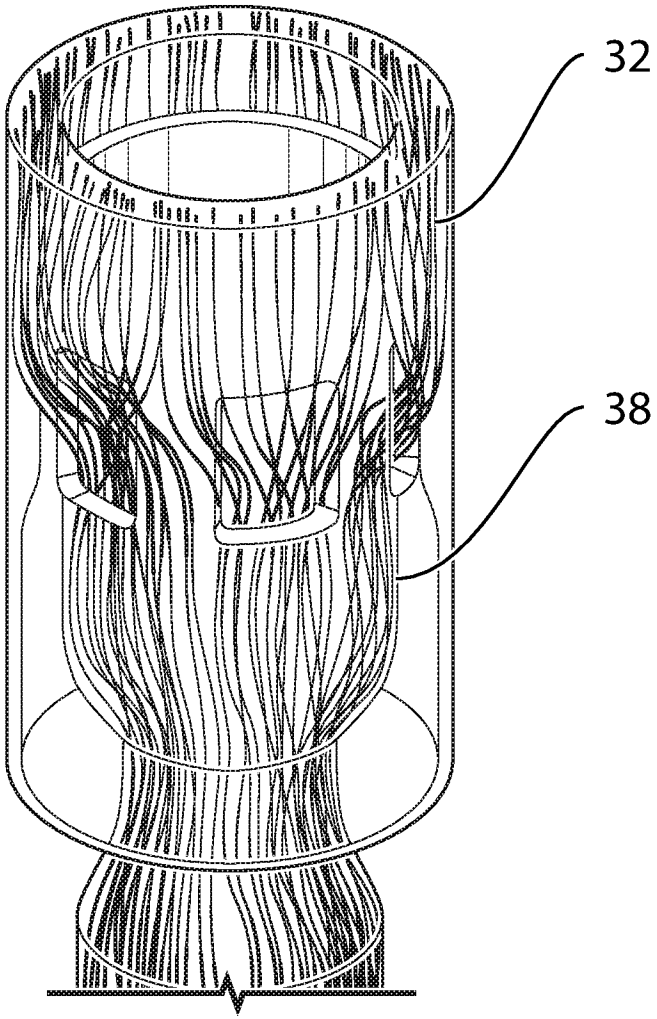
FIG. 3*a* is a top perspective view of one embodiment of the shuttle valve of the present invention, depicting fluid flow as it bypasses the shuttle valve.
Figure 4:
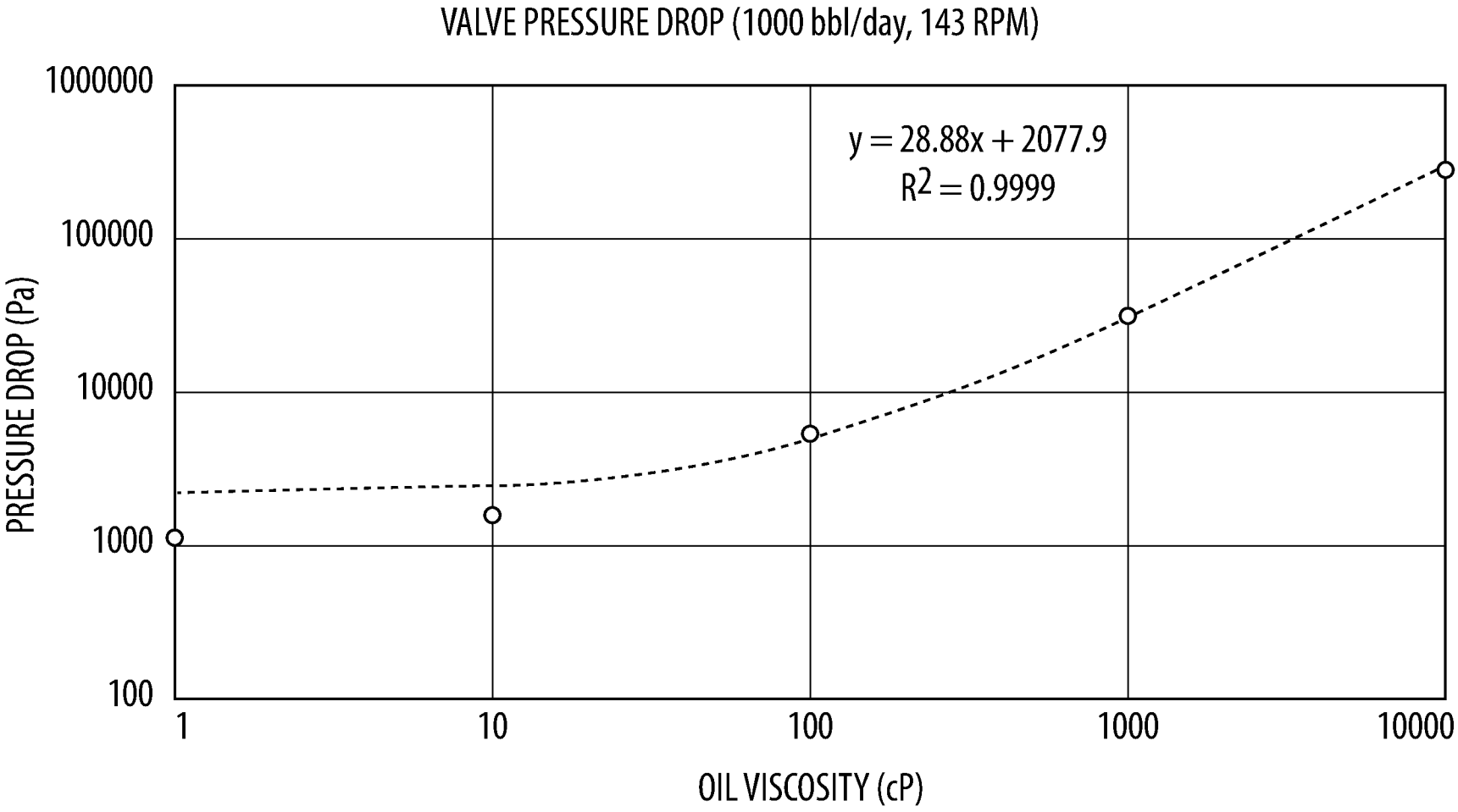
FIG. 4 is a graphical depiction of pressure drop as a function of oil viscosity, as fluid bypasses the shuttle valve of the present invention.

With reference to FIGS. 3*a*, 3*b* and 4, flow patterns of the pumped oil around the present shuttle valve 22 can be seen, in which darker lines represent compressive forces, or pressure losses and lighter lines show laminar flow with little to no pressure losses. It can be seen in both FIGS. 3*a* and 3*b* that flow losses are minimized to the areas just before and just after the shuttle 38. Around the shuttle 38 itself, the flow is laminar and with very low pressure losses. Furthermore, since the flow is laminar around the shuttle 38, undesirable re-circulation of fluids around profiles of the shuttle valve 22 are minimized.

With reference to FIG. 4, it can be seen that the maximum pressure drop across the present shuttle valve 22, corresponding with a typical maximum oil viscosity (8 API w/10,000 cps oil @1,000 bpd) is only about <35 psi, which is also quite low. These low pressure drops, low flow losses and the laminar flow regime around the present shuttle valve 22 are all achieved without the need to widen the ID of the tubing string 4 around the shuttle valve 22. Thus the present shuttle valve 22 can be run into a standard section of tubing string 4, with no loss in the tubing string-casing annular area 100.

Figures 5A, 5B, 5C, 5D, 5E:
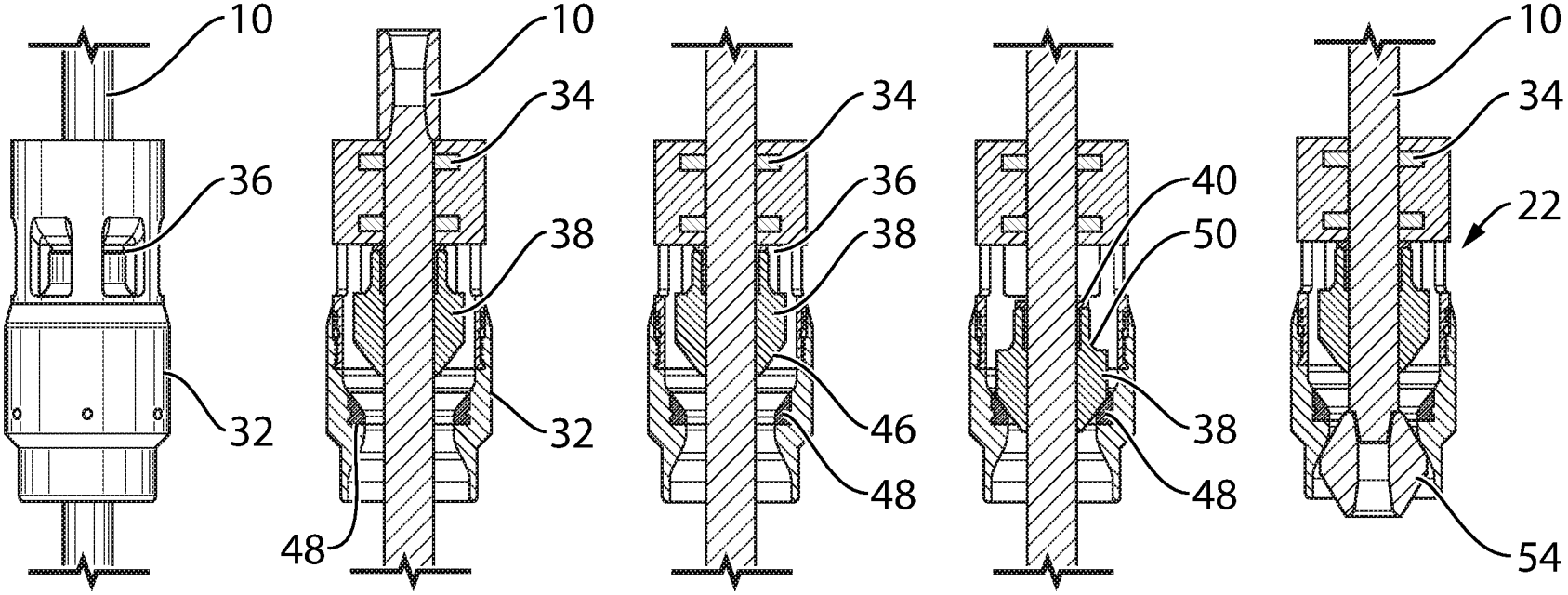
FIG. 5*a* is an elevation view of one embodiment of the shuttle valve of the present invention.
FIGS. 5*b* to 5*e* are cross-sectional views of one embodiment of the shuttle valve of the present invention in various statues of use.

The unique flare from the upper end 42 to the mid-section 44 of the present shuttle 38 advantageously forms a ledge 50. In the event of a PC pump 14 shut down, all that is required to close the shuttle valve 22 is the force of the downward flow of fluid in the tubing string 4 acting on this ledge 50 to seat shuttle 38 against seat 48, as seen in FIG. 5*d*. This allows for efficient closure of the shuttle valve 22 without the need for a weighted shuttle or ball, as seen in many prior art check valves, nor the need for springs or other mechanisms to aid in seating the shuttle or ball. Low friction from second bushing 40 further aids in efficiently lowering shuttle 38 onto seat 48.

Since the present shuttle 38 is not weighted, no extra work is needed by the PC pump 14 to lift the shuttle 38 off of the seat 48 during re-start up, or to keep the shuttle valve 22 in the open position during normal operation, as seen in FIGS. 5*b* and 5*c*.

The shuttle 38 preferably comprises one or more grooves 52 formed into the mid-section 44. These recessed grooves 52 serve to catch any particulate in the oil being pumped, thereby preventing particulate from building up on the surface of the shuttle 38 and potentially restricting the flow path of fluid around the shuttle 38. Preferably, the grooves 52 are angled to match a potential angle of the fluid flow as to moves upwards, thus allowing potentially swirling fluid flow around the shuttle 38 without rotating the shuttle 38 itself.

Further preferably, any particulate that catches on the seat 48 of the shuttle valve 22 is advantageously scraped down and away when the shuttle 38 seats itself on the seat 48, thereby minimizing particle build up on the seat 48.

The present invention thus provides three separate sealing areas to ensure that the shuttle valve restricts fluid flow when required. Namely, the present system provides sealing between the shuttle 38 and the seat 48; between the seating mandrel 20 and the seating nipple 18 and between the shuttle valve 22 and the rod string 10.

In the event that shuttle actuation fails for any reason, the present seating mandrel 20 can be removed via the non-deforming seating sleeve 60, then the unit brought to the surface, replaced and run downhole again.

The present shuttle valve system further presents a means of reducing failures in artificial lift systems due to deviated or un-centered drive rods. In deviated or horizontal wells, the tubing string 4 is commonly able to accommodate the well bore deviations and angles due some inherent flexibility in the tubing material. As the drive rod string 10 is installed inside the tubing string, it too has a degree of flexibility to accommodate the various angles or dog leg severity, also called "DLS". However, as the PC pump 14 begins to operate, the rod string 10 is put into tension as the weight of the fluid produced creates hydrostatic head and flow losses pull on the rod to place it under tension. The rod string 10 under tension loses its flexibility and cannot remain follow the bends and DSL required to stay centered inside the tubing string 4. Instead, the rod string 10 under tension tends to take the straightest route through the well. As the rod string 10 rotates in PC pump operation, it tends to rub against the inside diameter of the tubing string 4 and tubing and rod string wear lead to failure in the PC pumping wells.

The present shuttle valve 22 is designed to operate in deviated wells as the shuttle's minimal movement required for actuation allows it to operate in confined areas. Furthermore, advantageously, the rod string 10 itself is centered by the seating mandrel 20. The seating mandrel 20 when seated on the seating nipple 18 is automatically centered within the tubing string 4. By centering the seating mandrel 20 in the seating nipple 18, the seating mandrel 20 in turn centers the rod string 10 within the tubing string 4. Furthermore, in any deviation or horizontal application the shuttle 38 and seat 48 always remain centered and can operate properly. Also the sealing sleeve 60 of the seating mandrel 20 is flexible to accommodate deflection and allows for adjustment for harsher deviated well bore geometries. More preferably the seating mandrel 20 can be made from a material with sufficient strength so as not to wear out when side-loading forces on the rod string 10 causing any rubbing of the rod string 10 against an inner surface of seating mandrel 20.

Figure 6B:
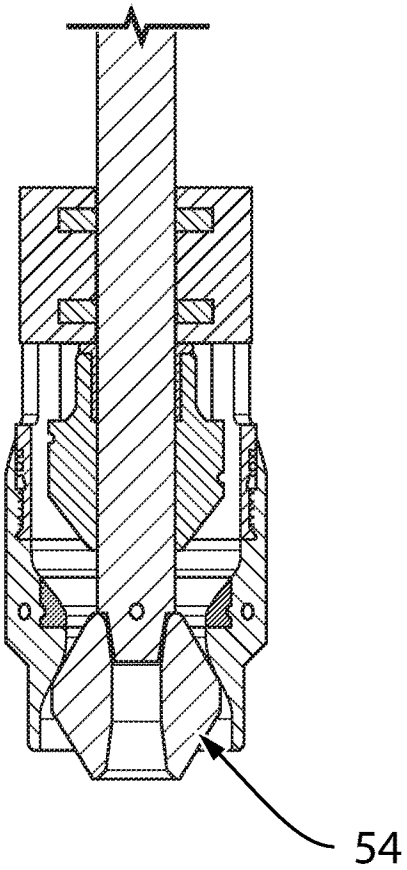
FIGS. 6*a* and 6*b* are cross sectional views of one embodiment of an optional pull rod for use with the shuttle valve of the present invention.
Figure 6A:
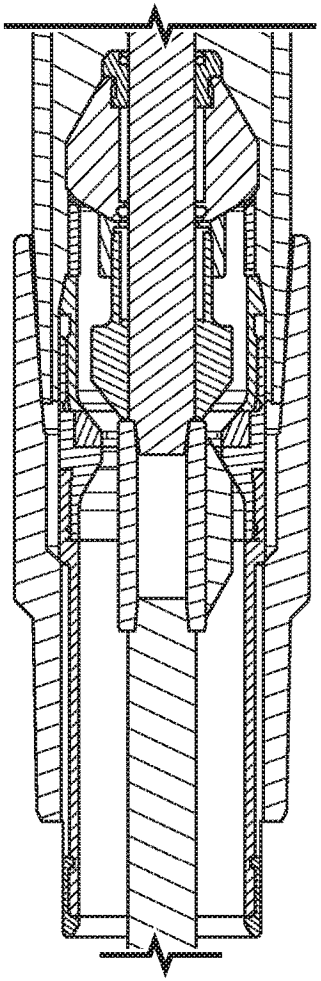
Figure 7:
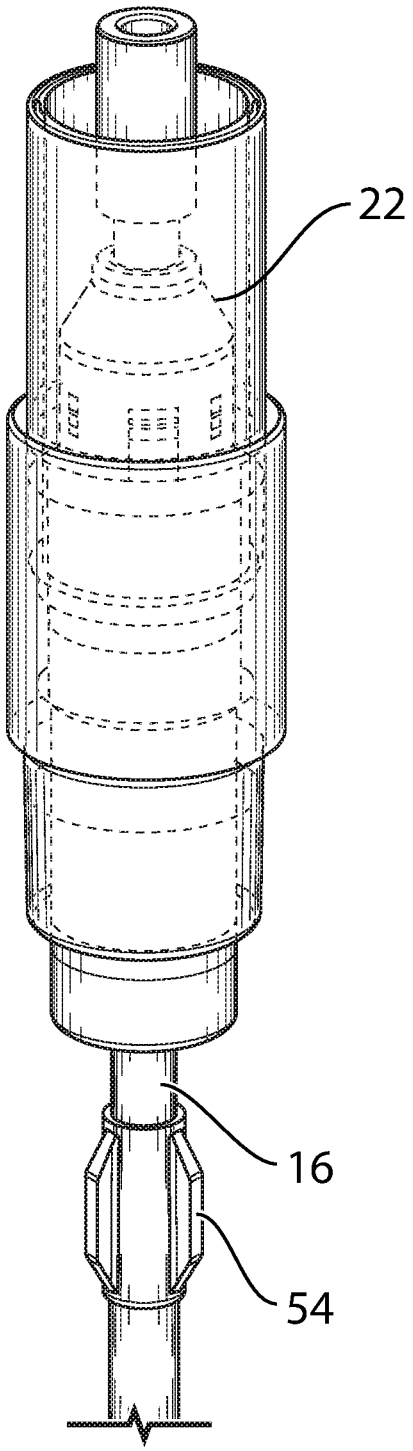
FIG. 7 is a perspective view of a rod sting having an embodiment of the shuttle valve of the present invention, a mandrel and a pull rod "no go" installed thereon.
Figure 8:
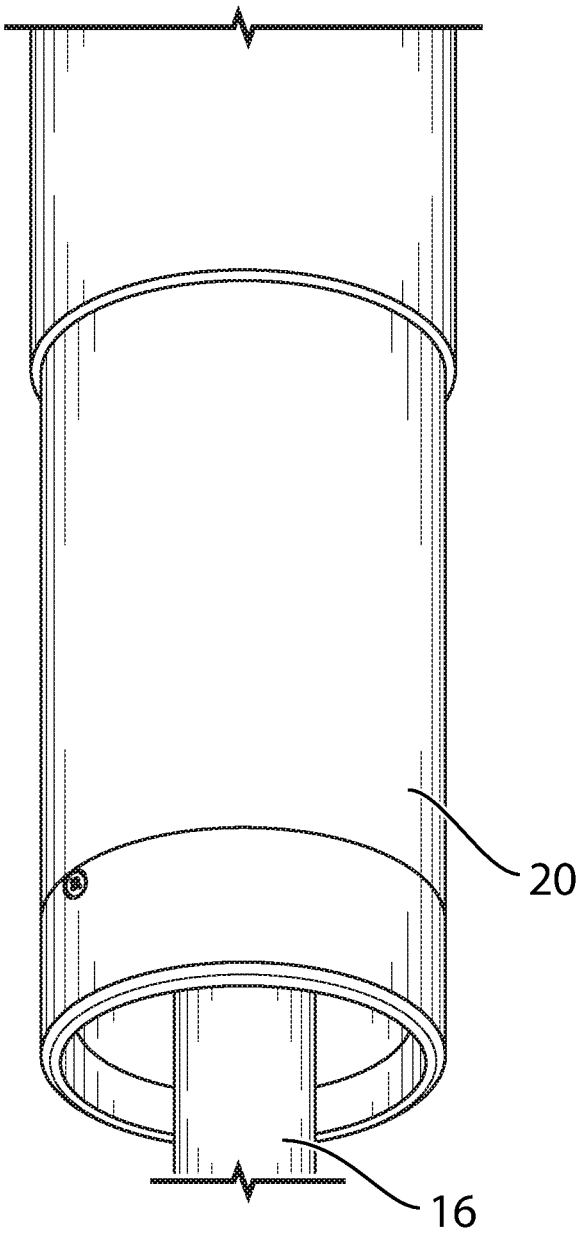
FIG. 8 is a bottom perspective view of a mandrel for use with one embodiment of the shuttle valve of the present invention.
Figure 9:
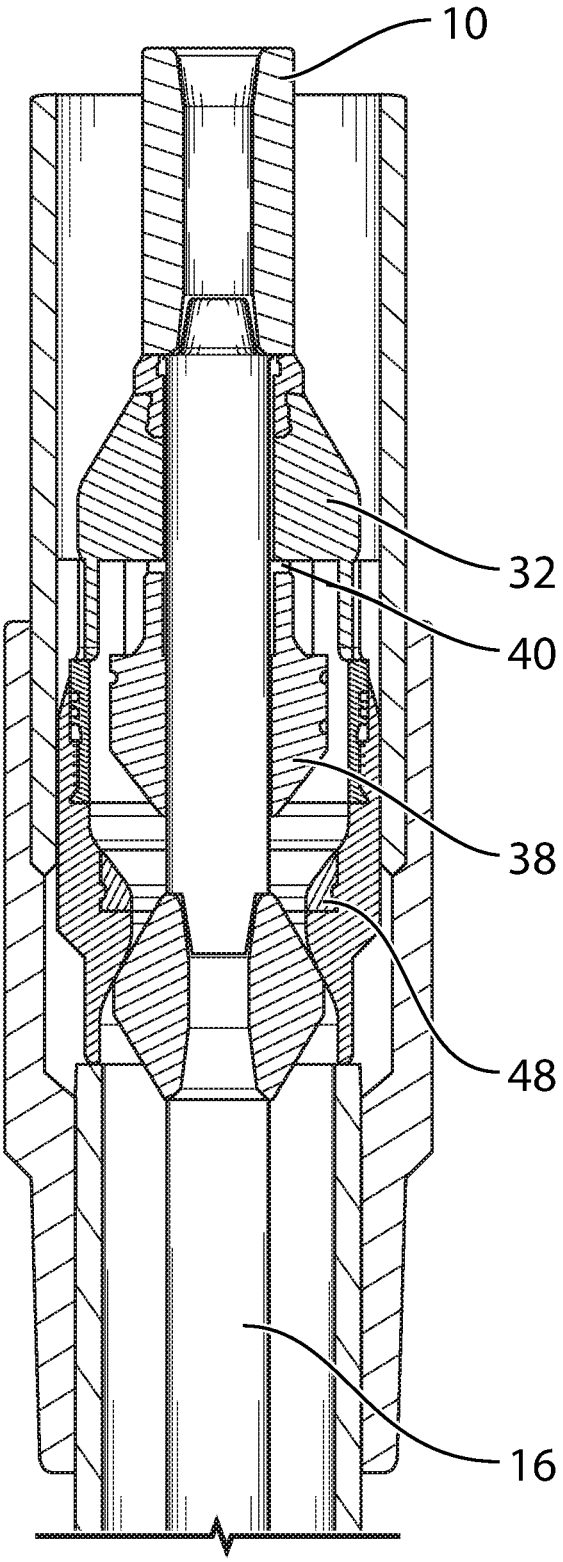
FIG. 9 is a cross-sectional elevation view of one embodiment of the shuttle valve of the present invention and a seating mandrel installed on a rod string.
Figure 10:
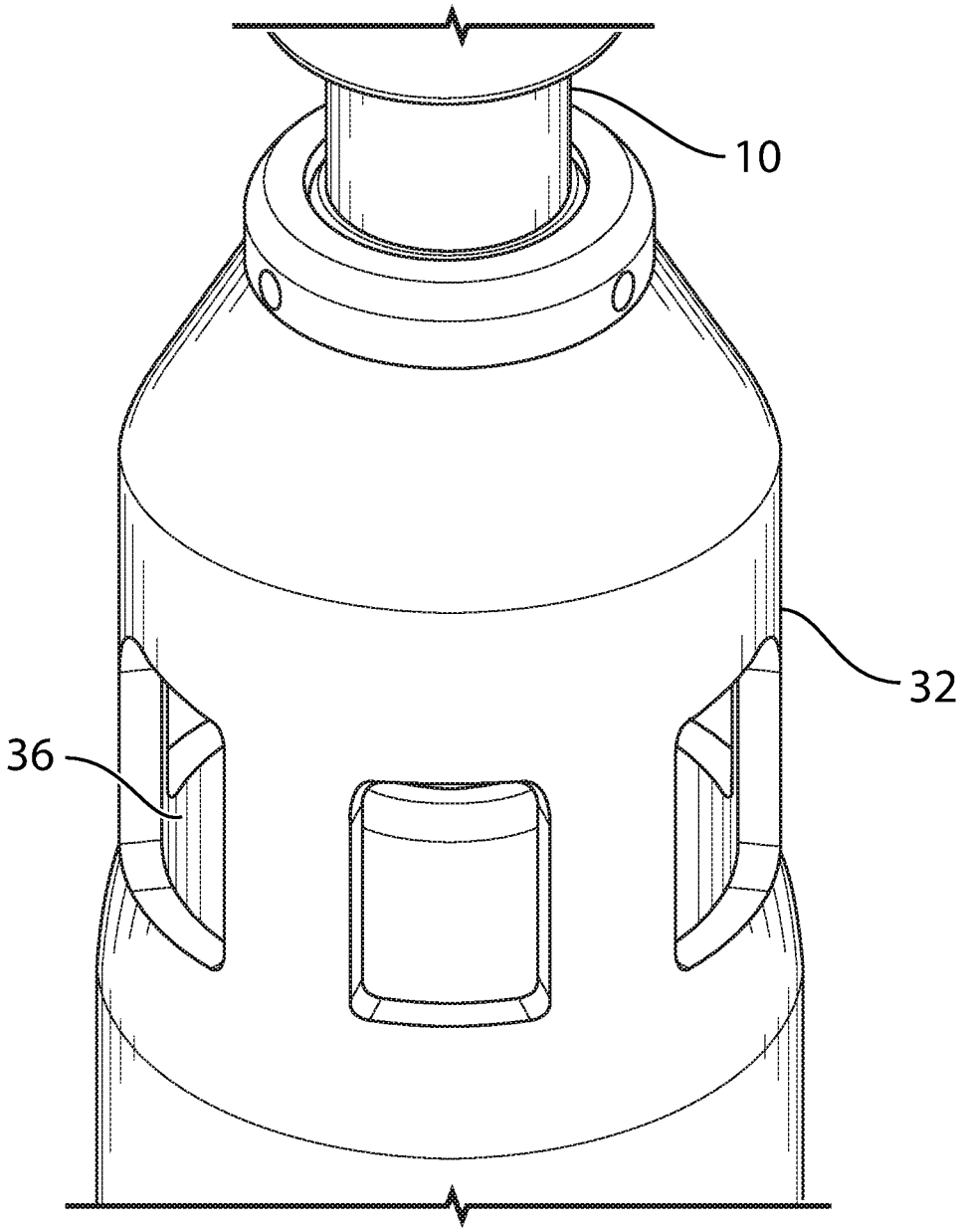
FIG. 10 is a detailed top perspective view of one embodiment of the shuttle valve of the present invention, showing the discharge ports.
Figure 11:
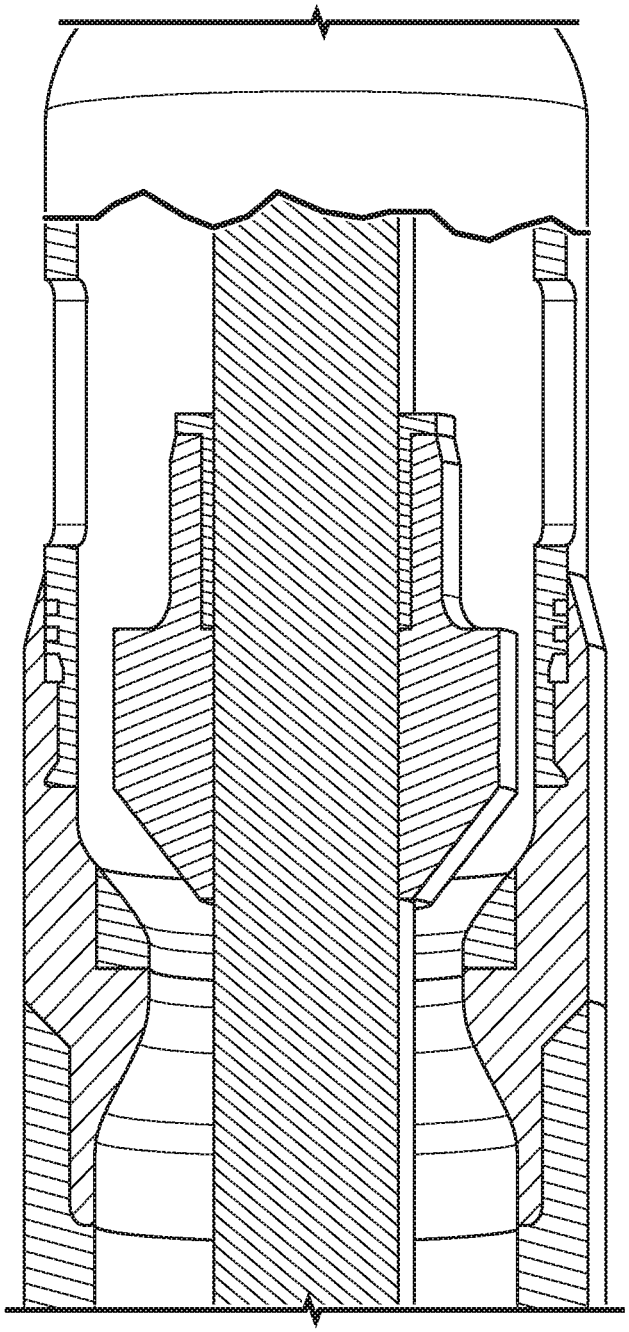
FIG. 11 is a detailed cross-sectional elevation view of one embodiment of the shuttle valve of the present invention.
Figure 12:
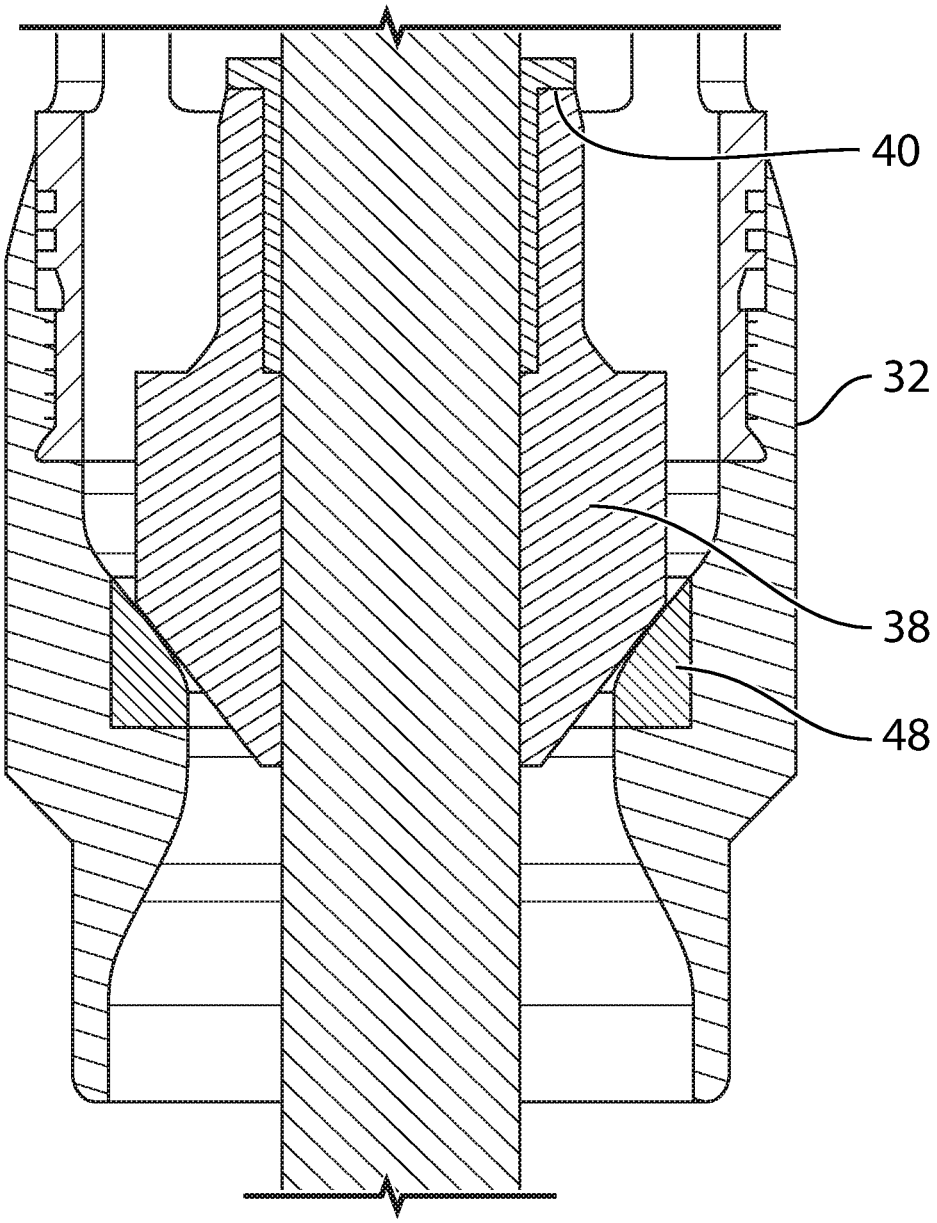
FIG. 12 is a detailed cross-sectional elevation view of the shuttle of one embodiment of the shuttle valve of the present invention.
Figure 13:
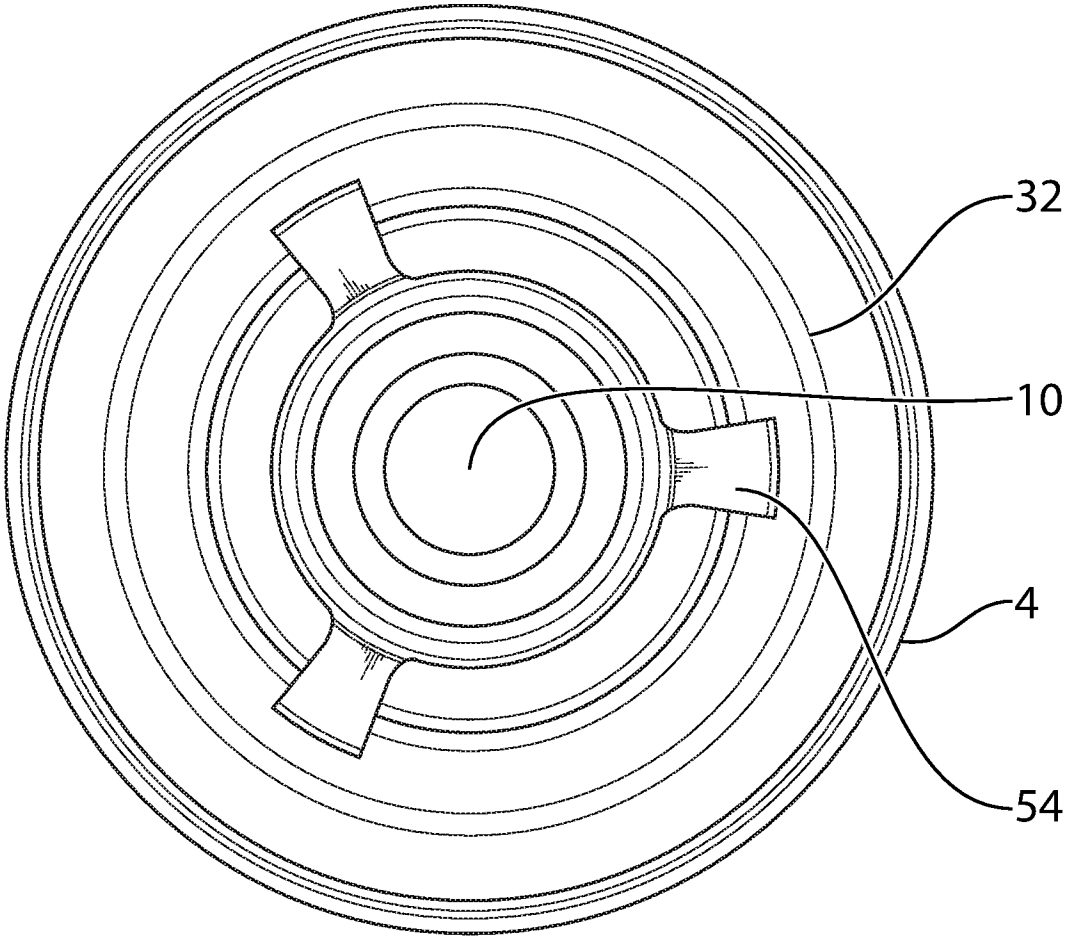
FIG. 13 is a bottom plan view of one embodiment of the shuttle valve of the present invention, showing a pull rod "no go".

With reference to FIGS. 6*a* and 6*b*, a pull rod no-go 54 is shown that is used to keep the shuttle valve in the open position when the entire rod string 10 is being pulled out of the tubing string 4. The pull rod "no-go" 54 is used for two functions: firstly to remove the entire system from the well during a work over; and secondly for flushing the system in the event that the well requires a circulation treatment. The "no-go" 54 connects to the shuttle valve 22 by lifting the rod string 10 up to surface until contact is made between the "no-go" 54 and the shuttle valve 22; contact weight indicators on the rig further preferably allow for contact visibility. The distance at which the "no-go" 54 is placed on the rod string 10 below the shuttle valve 22 is preferably pre-measured to allow for the rotor 12 to be completely removed from the stator 8. As well, the "no-go" 54 will release the shuttle valve 22 by contacting the shuttle 38 below the seat 48, thus lifting the shuttle 38 off its seat 48 and releasing the fluid above. Fluid will then flow past the shuttle 38 or it can be pumped past the shuttle 38 to stimulate the well bore.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The invention claimed is:

1. An upstream shuttle valve for use upstream of a progressive cavity pump, wherein said shuttle valve is run on a rod string and comprises an outer housing rotationally coupled to the rod string and a non-weighted shuttle that is moveable axially within the outer housing of said shuttle valve from flow of fluid alone, to open and close the shuttle valve.

2. The upstream shuttle valve of claim 1, wherein the shuttle valve comprises three separate sealing areas to reduce fluid losses between elements within the system.

3. The upstream shuttle valve of claim 2, where the three separate sealing areas comprise: sealing between the shuttle and a shuttle seat in the shuttle valve; sealing between a seating mandrel containing the shuttle valve and a seating nipple; and sealing between the shuttle valve and the rod string.

4. The upstream shuttle valve of claim 3, wherein the seating nipple is run on a tubing string and the seating mandrel of the shuttle valve is run on the rod string, wherein the seating mandrel seats on and seals against the seating nipple.

5. The upstream shuttle valve of claim 4, wherein the seating mandrel is surrounded by a sealing sleeve made from a non-metallic, non-elastomeric material to create a friction seal and mechanical seal.

6. The upstream shuttle valve of claim 3, wherein the outer housing is connected to the seating mandrel and is rotationally coupled to the rod string to allow rotation of the rod string.

7. The upstream shuttle valve of claim 6, wherein a coupling between the shuttle valve outer housing and the rod string comprises a first bushing made from a high temperature and high wear rating material designed to have close tolerances to both rod and shuttle valve and acts as a mechanical seal between an internal part of the shuttle valve and an outer surface of the rod.

8. The upstream shuttle valve of claim 7 wherein the shuttle seals against the rod string by a mechanical seal that restricts fluid by-pass and allows for shuttle actuation along the rod string based on fluid movement.

9. The upstream shuttle valve of claim 8, wherein the mechanical seal is formed by continuous contact between the shuttle and the rod via a second bushing, forming a single element, expandable and contractible seal on an inside surface of the shuttle and that reduces drag and friction between the shuttle and the rod.

10. The upstream shuttle valve of claim 9, wherein the first bushing and the second busing are made from a nanotube carbon composite.

11. The upstream shuttle valve of claim 1 wherein the shuttle is made from abrasion resistant, lightweight materials.

12. The upstream shuttle valve of claim 11, wherein the shuttle is made from zirconium ceramic.

13. The upstream shuttle valve of claim 12 wherein the shuttle comprises a conical lower end, wherein the conical lower end of the shuttle and the seat share a common angle of inclination to provide sealing and preventing deformation of the shuttle.

14. The upstream shuttle valve of claim 13, wherein the shuttle comprises an upper ledge onto which downward flow of fluid serves to seat the shuttle against the seat.

15. The upstream shuttle valve of claim 14, further comprising one or more grooves formed into a mid-section of the shuttle to catch particulate and reduce particulate build-up on an outer surface of the shuttle.

16. The upstream shuttle valve of claim 15, further comprising a no-go connected to the rod string and moveable to contact the conical lower end of the shuttle to lift the shuttle off of the seat and hold the shuttle valve in the open position when the rod string is pulled out of the tubing string.

17. The upstream shuttle valve of claim 1 wherein the shuttle valve is run on the rod string into a section of the tubing string having a similar inner diameter and outer diameter of the overall tubing string.

18. A method for pumping fluid from a wellbore in an artificial lifts system; said method comprising the steps of:

a. providing a progressive cavity pump;

b. providing a shuttle valve upstream of the progressive cavity pump, said shuttle valve comprising an outer housing rotationally coupled to the rod string and a non-weighted shuttle axially moveable within the outer housing of the shuttle valve;

c. opening the shuttle valve to allow flow of fluid upstream from the progressive cavity pump, through the shuttle valve, when the progressive cavity pump is pumping;

d. closing the shuttle valve to prevent flow of fluid downstream through the shuttle valve when the progressive cavity pump is stopped, wherein opening and closing of the shuttle valve is performed by moving the shuttle axially from force of fluid flow alone.

19. The method of claim 18 further comprising:

a. sealing between the shuttle and a shuttle seat;

b. sealing between a seating mandrel containing the shuttle valve and a seating nipple; and c. sealing between the shuttle valve and a rod string.

20. The method of claim 19, wherein the seating mandrel is surrounded by a sealing sleeve made from a non-metallic, non-elastomeric material to create a friction seal and mechanical seal.

21. The method of claim 19, further comprising rotationally coupling the outer housing of the shuttle valve to the rod string, to allow rotation of the rod string.

22. The method of claim 21, wherein rotationally coupling the shuttle valve outer housing to the rod string comprises providing a first bushing between the rod string and the outer housing.

23. The method of claim 22, further comprising providing a mechanical seal between the shuttle and the rod string to restrict fluid by-pass while allowing for shuttle actuation along the rod string based on fluid movement.

24. The method of claim 23, wherein the mechanical seal is formed by continuous contact between the shuttle and the rod via a second bushing, forming a single element, expandable and contractible seal on an inside surface of the shuttle to reduce drag and friction between the shuttle and the rod.

25. The method of claim 18 wherein the shuttle valve is provided on a section tubing having a similar inner diameter and outer diameter of an overall tubing string connected thereto.

26. The method of claim 18 for pumping fluid from a deviated wellbore, further comprising:

a. running the shuttle valve on a rod string into a tubing string, wherein the shuttle valve comprises a seating mandrel;

b. seating the seating mandrel in a seating nipple formed on the tubing string, wherein the seating mandrel to thereby center the seating mandrel in the seating nipple;

c. centering the rod string in the tubing string by centering the seating mandrel in the seating nipple.

* * * * *